US005879031A

United States Patent [19]

Bryant et al.

[11] Patent Number: 5,879,031

[45] Date of Patent: Mar. 9, 1999

[54] SOUND BAFFLE INSTALLATION AND RETENTION DEVICE

[75] Inventors: Martin D. Bryant, Murfreesboro, Tenn.; Michael J. Froehlich, Syracuse; John W. Fitzpatrick, Jr., Clinton, both of N.Y.

[73] Assignee: Carrier Corporation, Syracuse, N.Y.

[21] Appl. No.: 839,115

[22] Filed: Apr. 23, 1997

[51] Int. Cl.[6] ..... F16L 37/088; F01N 1/10

[52] U.S. Cl. ..... 285/49; 285/321; 181/258; 411/530; 24/27

[58] Field of Search ..... 285/49, 321; 181/212, 181/217, 219, 224, 258; 24/27, 483, 484; 411/517, 530

[56] References Cited

U.S. PATENT DOCUMENTS

| | | | |
|---|---|---|---|
| 655,688 | 8/1900 | Coleman et al. | 285/321 |
| 1,693,875 | 12/1928 | Tanaka | 411/530 |
| 1,992,093 | 2/1935 | Place | 411/530 |
| 2,865,662 | 12/1958 | Nurmse | 411/530 |
| 2,902,298 | 9/1959 | Kolthoff | 285/321 |
| 3,672,465 | 6/1972 | Blatt et al. | 181/258 |
| 3,820,199 | 6/1974 | Popper et al. | 411/530 |
| 4,286,976 | 9/1981 | Eriksson | 181/258 |
| 4,361,423 | 11/1982 | Nitz | 181/258 |
| 5,036,948 | 8/1991 | Henn | 181/258 |

FOREIGN PATENT DOCUMENTS

| | | | |
|---|---|---|---|
| 807871 | 7/1951 | Germany | 411/530 |
| 349329 | 5/1931 | United Kingdom | 411/517 |
| 1031999 | 6/1966 | United Kingdom | 285/321 |

*Primary Examiner*—Eric K. Nicholson

[57] ABSTRACT

A sound baffle retention clip for use in a combustion driven heating apparatus. The clip allows for positive retention of a sound baffle within the heat tube of a combustion driven heating apparatus without adversely affecting system operating performance. Further the clip allows for easy and efficient installation of the sound baffle without compromising the integrity of the heat tube.

4 Claims, 1 Drawing Sheet

SOUND BAFFLE INSTALLATION AND RETENTION DEVICE

BACKGROUND OF THE INVENTION

This invention relates generally to a device for installing and retaining a sound baffle within a heat tube of a combustion driven heating apparatus.

More particularly the present invention is a retention clip for installing and retaining a sound attenuating insert which is the subject of commonly assigned, co-pending U.S. patent application Ser. No. 08/783,559 filed Oct. 28, 1996. The disclosure of that application is hereby incorporated by reference.

Resonant sound produced by combustion driven heating apparatus is an onerous problem that produces objectionable noise levels. In a conventional combustion driven heating apparatus a fuel is ignited within a burner to produce a flame and hot gases. The hot gases, products of the combustion process, are introduced into a heat exchanger, or heat tube, and then exhausted through a flue stack to the atmosphere. Fluid to be heated, typically referred to as conditioned air, is passed over the outside of the heat tube whereby heat is transferred from the gases inside the heat tube to the exterior of the heat tube and finally to the fluid. The energy imparted to the heat tube by the burner, given certain physical characteristics of the heat tube, sometimes causes the combustion system to oscillate in phase with the natural frequency of the heat tube. This oscillation produces a standing acoustic wave within the heat tube which in turn produces the resonant sounds which are objectionable to humans. It is therefor important to dissipate the energy associated with the standing acoustic wave and thereby reduce the resonance type noise emission of the heating system. The installation of an energy dissipative device, or baffle, in the heat tube is one advantageous approach of dissipating this type of energy.

It is advantageous for system performance that the heat tube remain free from restriction to allow the gases to easily pass through the tube and out the flue stack. Any design that seeks to eliminate or suppress the resonant tones generated in such a system must keep the restriction of the heat tube to a minimum. The build up of combustion byproducts in the form of soot will likewise cause restrictions in the heat tubes that lead to system performance losses. It is typical in the operation of a combustion driven heating system that the heat tubes are frequently cleaned to prevent soot from building up on the heat tubes.

In an effort to eliminate resonant tones in a combustion driven heating system it is also important to prevent leakage of the gases from the heat tubes to the conditioned air. Leakage from the heat tubes to the conditioned air could introduce unreasonably high levels of undesirable gases to areas occupied by living beings. Any attempt to introduce a sound suppression device should therefore be done without piercing the heat tube or otherwise sacrificing the integrity of the seal between the gases and the conditioned air.

SUMMARY OF THE INVENTION

The present invention is an installation and retention device for use with a sound baffle in a heat tube of a combustion driven heating system. The device allows for repeated installation, proper positioning, and removal of the sound baffle without tools.

The device is designed to fit inside of the heat tube of a combustion driven heating system. The heat tube is essentially circular in cross section with a series of scallop features along its length. The exit end of the heat tube features an external groove integrally formed there in for slidably attaching to a vestibule plate. As a result of the forming of the external groove an adjacent internal groove is formed having a diameter slightly larger than the heat tube. The device is constructed from metal spring wire and is substantially circular in the planar section and adapted to engage the internal groove formed in the heat tube.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENTS

Figure 1:
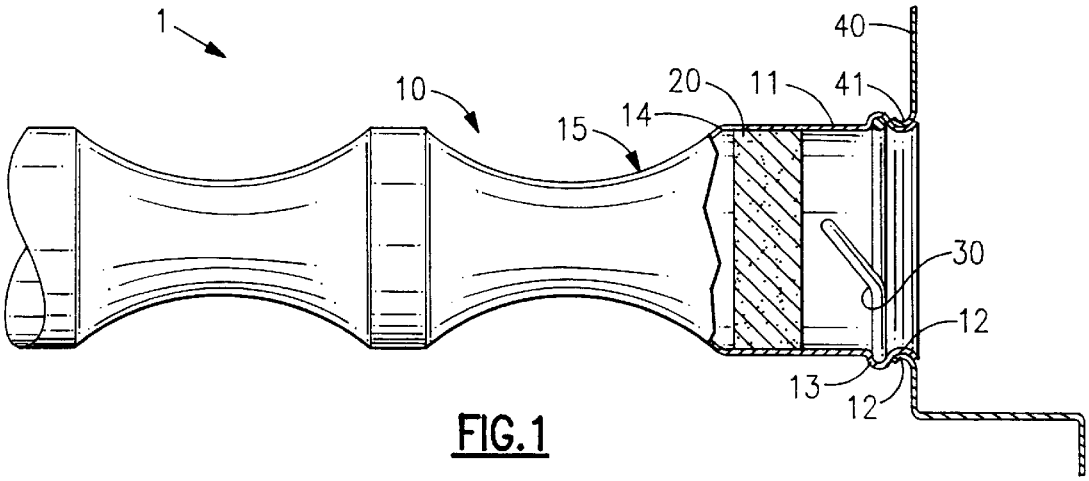
FIG. 1 is a section view of a combustion driven heating apparatus employing the sound baffle retaining clip of the present invention.

Referring to FIG. 1, there is illustrated a combustion driven heating apparatus employing the sound baffle retaining clip of the present invention. The apparatus 1 includes a heat tube 10, a noise reducing baffle 20, a baffle retaining clip 30, and a vestibule plate 40. The heat tube 10 has a substantially circular section 11 having an external groove 12, an internal groove 13 and a shoulder 14 formed at the intersection of the circular portion 11 and a scalloped portion 15 of the heat tube. The vestibule plate 40 has an annular opening 41 adapted to engage the external groove 12 of the heat tube. The noise reducing baffle 20 fits in slidable engagement within the circular section of the heat tube and stops against the shoulder 14. The baffle retaining clip 30 is compressively engaged within internal groove 13.

Figure 2:
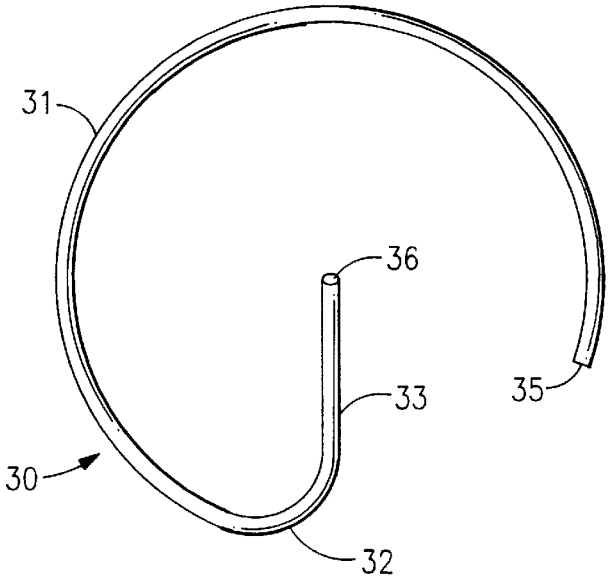
FIG. 2 is a plan view of the sound baffle retaining clip of the present invention.

Referring to FIG. 2, there is illustrated a baffle retaining clip 30 of the present invention. The clip is substantially a planar partial ring shaped body 31 having a first end 35, a second end 36, a shoulder 32 and a leg 33. The shoulder and the first end are spaced apart to form a gap in the body to permit the ring shaped portion of the clip to be flexed to a diameter smaller than that of the external groove of the heat tube. The second end 36 is turned inwardly at the shoulder 32 toward the center of the body to form a leg 33 to facilitate flexure of the clip.

Figure 3:
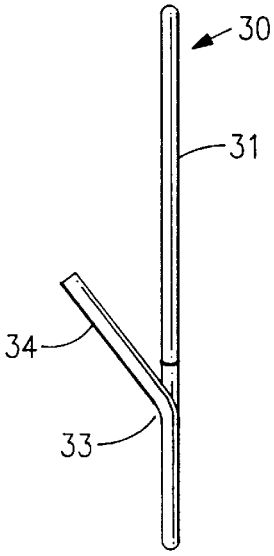
FIG. 3 is a side view of the sound baffle retaining clip of the present invention.

Referring to FIG. 3, there is illustrated a side view of the baffle retaining clip 30 of the present invention. The leg 33 of the clip has upturned portion 34 directed out of the plane of the ring portion. The ring portion of the clip is larger in diameter, in its unrestrained condition, than the internal groove of heat tube to permit compressive engagement between the clip and the internal groove.

With the sound reducing baffle 20 installed in the heat tube the clip 30 is then passed through the annular opening 41 of the vestibule plate and installed into the external groove 13 and the sound reducing baffle is retained by the upturned portion of the leg 33. The clip can be manipulated by the leg 33 to facilitate the installation the clip.

The present invention allows for easy and efficient installation of the sound reducing baffles. The clip is engaged compressively within the heat tube thereby avoiding the need to pierce the heat tube for attachment by fasteners or other methods of engagement. The risk of flue gases escaping into the condition air through a hole pierced in the heat tube is consequently eliminated. Another advantage of the present invention is that it allows for easy and tooless installation and removal of the sound reducing baffles thereby allowing for easy servicing of the baffle and cleaning of the heat tube.

In one embodiment of the present invention the sound suppression baffle retaining clip is formed from a single piece of 0.076" diameter 302 type stainless steel. The unrestrained outside diameter of the clip is 2.5" while the heat tube internal groove diameter is 2.4" causing a compressive interference between the clip and the tube.

What is claimed is:

1. A combination of a cylindrical heat tube and a resilient internal retaining clip for releasably retaining a sound baffle within the heat tube comprising:

a heat tube adapted to receive the baffle and having an annular groove formed therein;

a retaining clip having a substantially planar partial ring shaped body having an unrestricted dimension greater than the groove and further having a first end, a second end and a shoulder;

the shoulder and the first end being spaced apart to form a gap in the body to permit the ring shaped portion of the clip to be compressed to a dimension smaller than the inside of the heat tube;

the second end turned inwardly at the shoulder extending toward the center of the body to form a leg to facilitate compression of the clip;

wherein the partial ring portion of the clip is compressively received into the annular groove such that said leg retains the baffle.

2. A resilient internal retaining clip according to claim 1, wherein the leg further comprises a portion directed out of the plane of the body at the shoulder to bias the baffle in the direction of the heat tube.

3. A resonance type noise suppression system for use with a combustion driven heating apparatus including at least one heat tube having an inlet end and an outlet end and defining a gas flow passageway extending from the inlet end to the outlet end for receiving an energy dissipative device disposed within and substantially filling the cross-sectional area of the gas flow passageway of the heat tube and further having an internal annular groove formed therein said system further including a resilient internal retaining clip comprising:

a substantially planar partial ring shaped body having an unrestricted dimension greater than the groove and further having a first end, a second end and a shoulder;

the shoulder and the first end being spaced apart to form a gap in the body to permit the ring shaped portion of the clip to be compressed to a dimension smaller than the inside of the heat tube;

the second end being turned inwardly at the shoulder and extending toward the center of the body to form a leg to facilitate compression of the clip;

wherein the heat tube groove compressively receives the partial ring portion of the clip such that the leg retains the energy dissipative device within the heat tube.

4. A resonance type noise suppression system according to claim 3, wherein the leg further comprises a portion directed out of the plane of the body at the shoulder to bias the energy dissipative device in the direction of the heat tube.

* * * * *